US011752063B1

(12) United States Patent
Huang et al.

(10) Patent No.: US 11,752,063 B1
(45) Date of Patent: Sep. 12, 2023

(54) PENIS MASSAGER

(71) Applicant: Junpeng Wu, Shenzhen (CN)

(72) Inventors: Tenghui Huang, Guangdong (CN); Junpeng Wu, Shenzhen (CN)

( * ) Notice: Subject to any disclaimer, the term of this patent is extended or adjusted under 35 U.S.C. 154(b) by 0 days.

(21) Appl. No.: 18/122,789

(22) Filed: Mar. 17, 2023

(30) Foreign Application Priority Data

Mar. 8, 2023 (CN) ..... 202320430028.3

(51) Int. Cl.
*A61H 19/00* (2006.01)

(52) U.S. Cl.
CPC ..... *A61H 19/32* (2013.01); *A61H 2201/0107* (2013.01); *A61H 2201/1215* (2013.01); *A61H 2201/149* (2013.01); *A61H 2201/1669* (2013.01); *A61H 2201/1671* (2013.01)

(58) Field of Classification Search
CPC ..... A61H 19/32; A61H 2201/0107; A61H 2201/1215; A61H 2201/149; A61H 2201/1669; A61H 2201/1671
See application file for complete search history.

(56) References Cited

U.S. PATENT DOCUMENTS

2004/0082831 A1* 4/2004 Kobashikawa ..... A61H 19/32 600/38
2005/0228219 A1* 10/2005 Jewell ..... A61H 19/32 600/38
2008/0065033 A1* 3/2008 Matsuura ..... A61H 9/005 604/349
2010/0152631 A1* 6/2010 Knyrim ..... A61H 19/32 601/89
2012/0232335 A1* 9/2012 Eisenberg ..... A61H 19/32 600/38
2015/0034504 A1* 2/2015 Clayton ..... A61H 19/44 206/38
2015/0196454 A1* 7/2015 Levy ..... A61H 19/32 600/38
2016/0120736 A1* 5/2016 Yeung ..... A61H 19/32 601/46
2016/0279020 A1* 9/2016 Timmermans ..... A61H 19/00
2017/0071818 A1* 3/2017 Chen ..... A61H 19/32
2017/0231801 A1* 8/2017 Matsuura ..... A61H 19/00 600/38
2018/0092798 A1* 4/2018 Shao ..... A61H 19/32
2023/0126338 A1* 4/2023 Shao ..... H02K 7/14 600/38

* cited by examiner

*Primary Examiner* — Timothy A Stanis

(57) ABSTRACT

A penis massager includes a housing, a massaging member and a driving apparatus. The massaging member includes a first sleeve and a second sleeve which are spaced apart. The first sleeve is positioned at a front side of the second sleeve. The first sleeve has an inner lumen penetrating two axial ends thereof to allow a head of the penis to extend through the first sleeve and enter into the second sleeve, and the second sleeve is rotatably disposed. The driving apparatus is disposed within the housing and in transmission connection with the massaging member. The driving apparatus can drive the first sleeve to linearly move in an axial direction along the penis inserted in the first sleeve, and driving the second sleeve to rotate relative to the housing.

20 Claims, 13 Drawing Sheets

PENIS MASSAGER

CROSS-REFERENCE TO RELATED APPLICATIONS

This application claims priority to Chinese Patent Application No. 202320430028.3 filed on Mar. 8, 2023, the entire contents of which are hereby incorporated by reference.

TECHNICAL FIELD

The present disclosure relates to the technical field of massaging apparatuses, and more particularly to a penis massager.

DESCRIPTION OF THE PRIOR ART

Penis massagers are configured for simulating a vaginal environment and providing a massaging stimulation to the male genitalia. Generally, the penis massager generates a massaging effect through a sleeve driven by vibration. However, the typical penis massager has a single massaging effect, and the stimulations to the penises are insufficient, which results in poor experience of the user.

SUMMARY OF THE DISCLOSURE

An object of an embodiment of the present disclosure is to provide a penis massager with good user experience.

In order to achieve the above-mentioned object, a technical solution employed by the present disclosure is to provide a penis massager, including:

a housing;

a massaging member including a first sleeve and a second sleeve which are spaced apart, the first sleeve being positioned at a front side of the second sleeve, the first sleeve has an inner lumen penetrating two axial ends thereof to allow a head of the penis to extend through the first sleeve and enter into the second sleeve, and the second sleeve being rotatably disposed; and a driving apparatus disposed within the housing and in transmission connection with the massaging member, the driving apparatus being capable of driving the first sleeve to linearly move in an axial direction along the penis inserted into the first sleeve, and driving the second sleeve to rotate relative to the housing.

The penis massager provided by the present disclosure has the following beneficial effects than the prior art, the driving apparatus of the penis massager provided by the present disclosure can drive the first sleeve to linearly move and the second sleeve to rotate, thus providing telescopic massage for the middle of the penis and rotary massage for the head of the penis, which brings diversified massaging effect. Moreover, the penis massager has a simple structure since a few components are employed. The massaging member includes the first sleeve and the second sleeve spaced apart. A user can adjust movement speeds of the first sleeve and the second sleeve respectively by controlling the driving apparatus to achieve a more comfortable massaging effect, which can provide more stimulation combinations for the user, meeting different needs of different users, and improving the applicability of the penis massager.

BRIEF DESCRIPTION OF DRAWINGS

In order to more clearly explain technical solutions in embodiments of the present disclosure, accompanying drawings required to be used in the embodiments or the description of the prior art will be briefly introduced below. Apparently, the accompanying drawings in the following description are only some embodiments of the present disclosure. For those ordinarily skilled in the art, other accompanying drawings can be obtained from these accompanying drawings without paying any creative labor.

DESCRIPTION OF EMBODIMENTS

In order to make technical problems, technical solutions and beneficial effects to be solved in the present disclosure clearer, the present disclosure will be further described below in detail in conjunction with accompanying drawings and embodiments. It should be understood that specific embodiments described herein are only used to explain the present disclosure and not to limit the present disclosure.

It should be noted that when an element is referred to as "fixed to" or "arranged on" another element, it can be directly or indirectly on another element. When an element is referred to as "connected to" another element, it can be directly or indirectly connected to another element.

It should be understood that the orientational or positional relationship indicated by terms "length", "width", "up", "down", "front", "back", "left", "right", "vertical", "horizontal", "top", "bottom", "inside", "outside", and the like is based on the orientational or positional relationship shown in the accompanying drawings, and is only for the sake of describing the present disclosure and simplifying the description instead of indicating or implying that the apparatus or element referred to must have a specific orientation, and must be constructed and operated in a specific orientation, so it cannot be understood as a limitation of the present disclosure.

Also, terms "first" and "second" are only used for describing purposes, and cannot be understood as indicating or implying relative importance or implying the number of technical features indicated. Therefore, features defined with "first" and "second" can explicitly or implicitly include one or more of these features. In the description of the present disclosure, "a plurality of" means two or more, unless otherwise specified.

Figure 1:
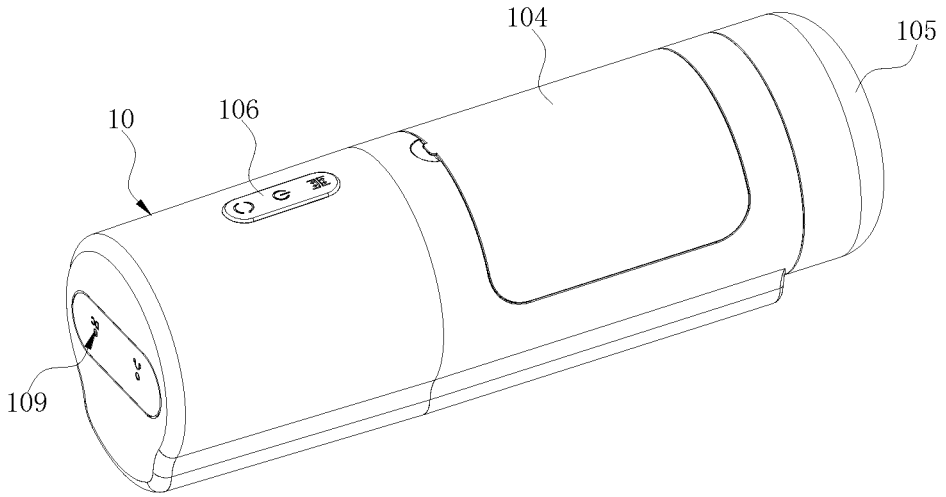
FIG. 1 is a perspective view of a penis massager according to an embodiment of the present disclosure.

Now, referring to FIG. 1 to FIG. 3 together, the penis massager provided by an embodiment of the present disclosure will be described. The penis massager includes a housing 10, a massaging member 20 and a driving apparatus 30. The housing 10 includes an inner cavity. An opening is provided in a front end of the housing 10. An end cover 105 is detachably mounted on the front end of the housing 10 at the opening. The end cover 105 closes the opening in the front end of the housing 10.

The massaging member 20 may be made of an injection molded part, such as a silicone injection molded part. The massaging member 20 includes a first sleeve 210 and a second sleeve 220 which are arranged spaced from each other within the housing 10. In some embodiments, the first sleeve 210 and/or the second sleeve 220 may be made of a soft material. The first sleeve 210 is coaxially positioned at a front side of the second sleeve 220. A lateral cover 104 is detachably connected to a lateral surface of the housing 10. After the lateral cover 104 is removed, the first sleeve 210 can be taken out of the housing 10 from a lateral opening of the housing. A front end and a rear end of the first sleeve 210 each are provided with an opening aligned with the opening of the housing at the front end. The opening in the front end of the first sleeve 210 forms an inlet for inserting of the penis, and the opening in the rear end of the first sleeve 210 allows the penis to extend out there from. The second sleeve 220 has a structure in which a front end is provided with an opening and a rear end is closed. After the penis is inserted into the massage member 20, the head of the penis extends into the second sleeve 220 after passing through the first sleeve 210, and the second sleeve 220 covers the head of the penis. In other words, the first sleeve 210 has an inner lumen 211 penetrating two axial ends thereof to allow a head of the penis to extend through the first sleeve 210 and enter into the second sleeve 220, The driving apparatus 30 is accommodated within the housing 10. The driving apparatus 30 is in transmission connection with the massaging member 20. The driving apparatus 30 can drive the first sleeve 210 to linearly move in the housing 10 in an axial direction, such that the first sleeve 210 can linearly and axially move along the penis inserted in the first sleeve 210, so as to provide an axial massage to the penis. The driving apparatus 30 can drive the second sleeve to rotate about an axial axis within the housing 10 relative to the housing 10, such that the second sleeve 220 can provide a rotary massage to the head of the penis. Numerous small massaging protrusions 21 are provided on an inner wall surface of the first sleeve 210 and an inner wall surface of the second sleeve 220, respectively, which can improve the massaging effect. In this embodiment, a plurality of small massaging protrusions 21 are provided on the inner wall surface of the first sleeve 210 at positions near the front end of the first sleeve 210, and helical ribs 22 are provided on the inner wall surface of the first sleeve 210 at positions near the rear end of the first sleeve. The housing 10 is provided with a control panel 106 on which a plurality of function keys are disposed. By pressing the function keys, moving speeds of the first sleeve 210 and the second sleeve 220 can be controlled and adjusted. In this way, the user can adjust the penis massager to a comfortable massaging mode and further achieve a better massaging experience.

Compared with the prior art, the penis massager provided by the present disclosure can drive the first sleeve 210 to linearly move in the axial direction and the second sleeve 220 to rotate about the axial axis, thereby providing the axial movement massage for the middle of the penis and the rotary massage for the head of the penis, which achieves various massaging effects. Moreover, the penis massager has a simple structure since a few of components are employed. The massaging member 20 includes the first sleeve 210 and the second sleeve 220 spaced apart. A user can adjust moving speeds of the first sleeve 210 and the second sleeve 220 respectively by controlling the driving apparatus 30 to achieve a more comfortable massaging effect, which can provide more stimulating combinations for the user, meeting different needs of different users, and improving the applicability of the penis massager.

Figure 2:
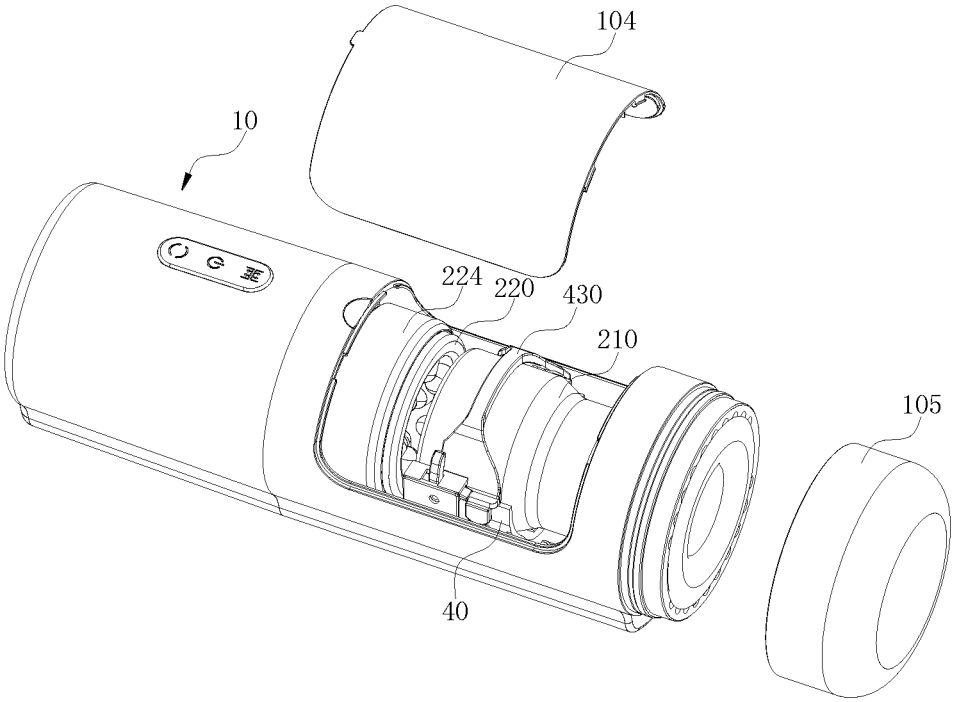
FIG. 2 is a first exploded view of the penis massager shown in FIG. 1.
Figure 3:
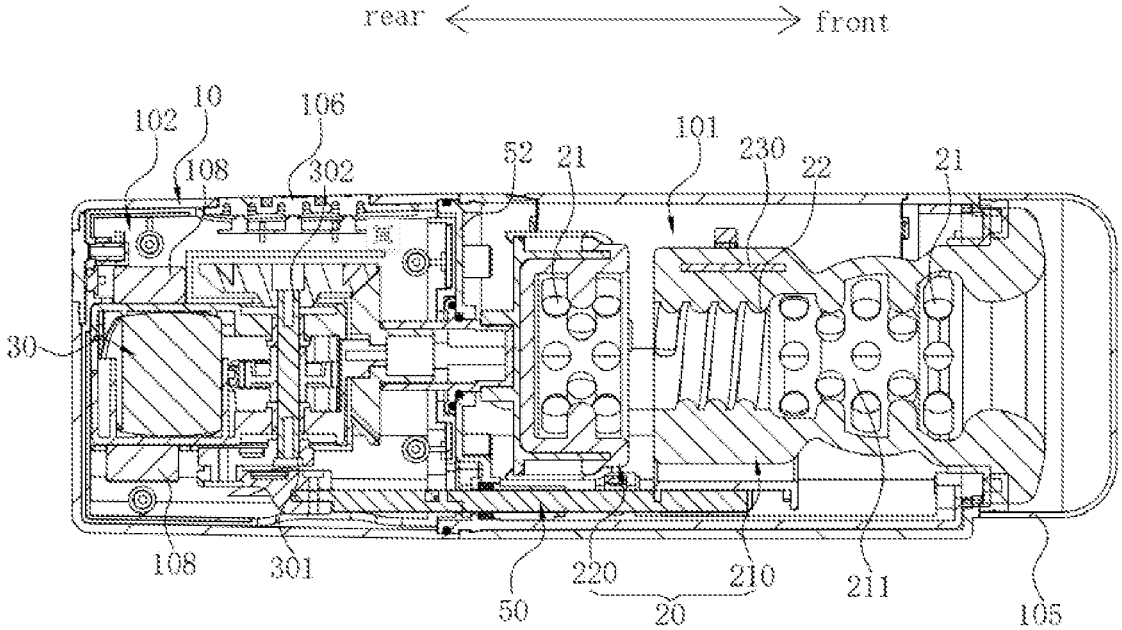
FIG. 3 is a sectional view of the penis massager shown in FIG. 1.
Figure 4:
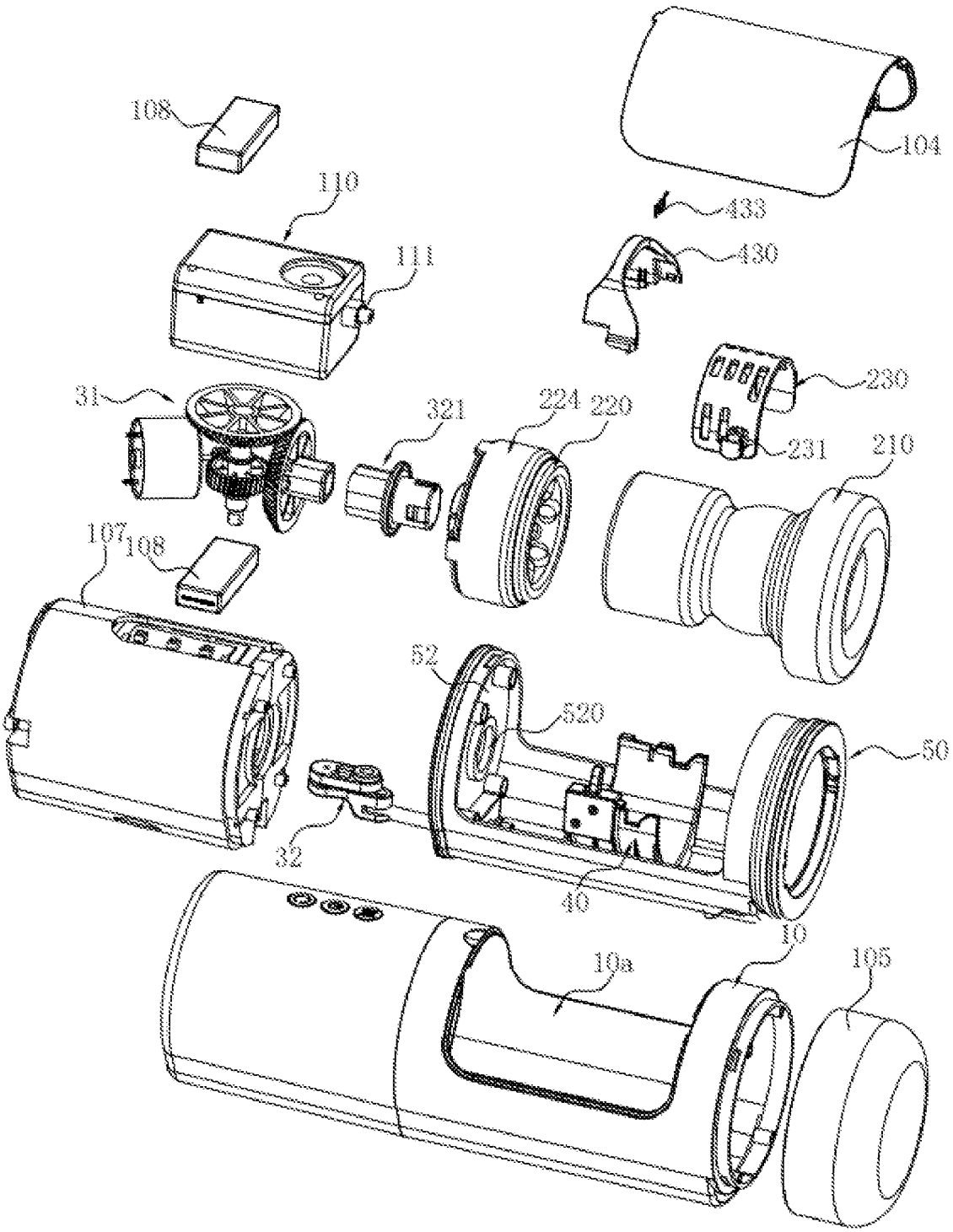
FIG. 4 is a second exploded view of the penis massager shown in FIG. 1.

Referring to FIG. 2 to FIG. 4, a partitioning plate 52 is disposed within the housing 10. The partitioning plate 52 divides an internal cavity 10*a* of the housing 10 into a first chamber 101 and a second chamber 102. The massaging member 20 is disposed in the first chamber 101. The driving apparatus 30 is disposed in the second chamber 102. The second sleeve 220 is rotatably arranged on the partitioning plate 52.

The driving apparatus 30 may include a single motor or double motors for driving. The driving apparatus 30 includes an actuator 31 which has a first output shaft 301 and a second output shaft 302. The first output shaft 301 is in transmission connection with the first sleeve 210 through a first transmission mechanism 32, and the second output shaft 302 is in transmission connection with the second sleeve 220.

Referring to FIG. 4 to FIG. 7, in this embodiment, the actuator 31 includes a single motor. Particularly, the actuator 31 includes a motor 34, a worm shaft 341, a first worm gear 342 and a transmission shaft 343. A fixed casing 110 is disposed in the second chamber 102 of the housing 10, and the actuator 31 is accommodated within the fixed casing 110. An axial direction of an output shaft 340 of the motor is perpendicular to an axial direction of the transmission shaft 343. The first worm gear 342 is fixedly mounted around the middle of the transmission shaft 343. Two shaft sleeves 344 are mounted around and cover two ends of the transmission shaft 343, respectively. The transmission shaft 343 can rotate relative to the shaft sleeves 344. Two ends of the transmission shaft 343 are rotatably connected with the fixed casing 110 through the shaft sleeves 344. The worm shaft 341 is connected to the output shaft of the motor 34, and the worm shaft 341 meshes the first worm gear 342. The two ends of the transmission shaft 343 extend out of the fixed casing 110 to serve as the first output shaft 301 and the second output shaft 302, respectively.

Figure 7:
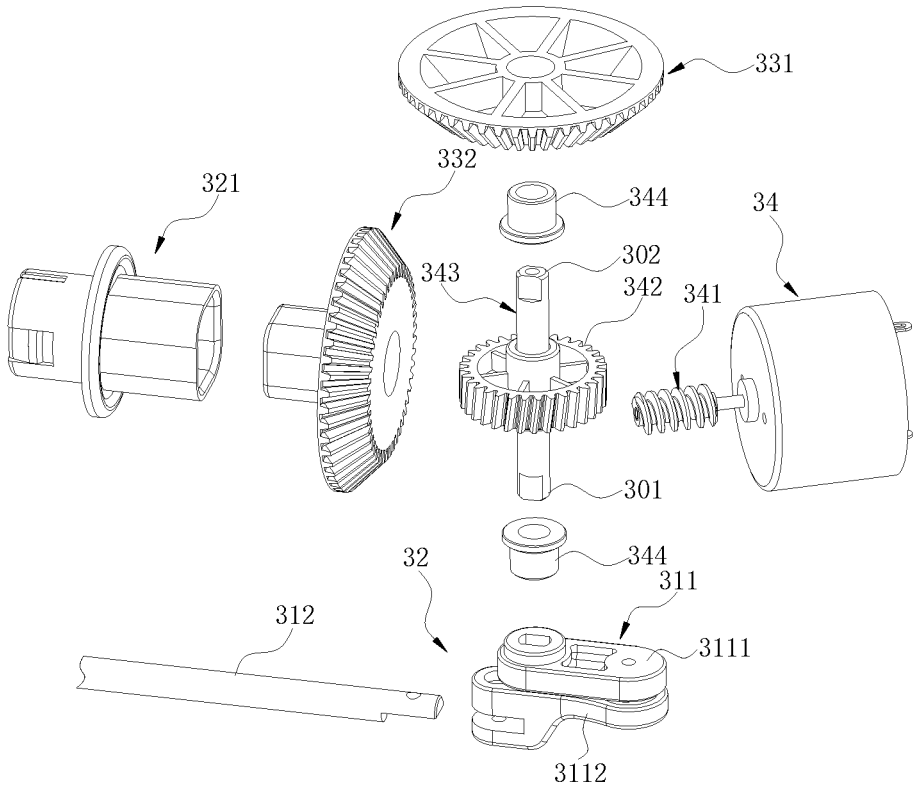
FIG. 7 is a schematic partially-exploded view of the penis massager shown in FIG. 2.

The second output shaft 302 is in transmission connection with the second sleeve 220 through a second transmission mechanism 33. The second transmission mechanism 33 includes a second worm gear 331 and a third worm gear 332 which mesh each other. The second worm gear 331 is connected to the second output shaft 302. A protruding axle 111 is provided at a front side of the fixed casing 110. One axial end of the third worm gear 332 is rotatably mounted around the protruding axle 111 of the fixed casing 110, and the other axial end of the third worm gear 332 is connected to the second sleeve 220. The motor 34 drives the first worm gear 342 through the worm shaft 341 to rotate when being energized, and then drives the transmission shaft 343 to rotate. One end of the transmission shaft 343 drives the first sleeve 210 to reciprocate axially through the first transmission mechanism 32, and the other end of the transmission shaft 343 drives the third worm gear 332 to rotate on the fixed casing 110 through the second worm gear 331, and then drives the second sleeve 220 to rotate about the axial axis. In this embodiment, the first sleeve 210 and the second sleeve 220 can be driven by using one motor 34, the structure is simple and the cost is low. Referring to FIG. 1, FIG. 4 and FIG. 7, an inner casing 107 is disposed within the housing 10, the fixed casing 110 is fixed in the inner casing 107, a rechargeable battery 108 is disposed in the inner casing 107, the motor 34 is electrically connected to the rechargeable battery 108, a charging port 109 is provided at a rear end of the housing 10, and the rechargeable battery 108 can be charged through the charging port 109.

It should be understood that, in other embodiments, the actuator 31 using the single motor may not have the worm shaft 341, the first worm gear 342 and the transmission shaft 343. For example, the actuator 31 may adopt a motor with double-output shafts, and the output shafts of the motor extend out of two opposite sides to serve as the first output shaft 301 and the second output shaft 302, respectively. An axial direction of the output shafts of the motor is parallel to a width direction of the housing. A fixed casing 110 is disposed within the second chamber 102, and the output shafts of the motor extend out of the two opposite sides of the fixed casing 110. The end of one output shaft of the motor drives the first sleeve 210 through the first transmission mechanism 32 to reciprocate axially, and the end of the other output shaft of the motor drives the second sleeve 220 through the second transmission mechanism 33 to rotate. In this way, it also achieves the drive of the first sleeve 210 and the second sleeve 220.

Figure 5:
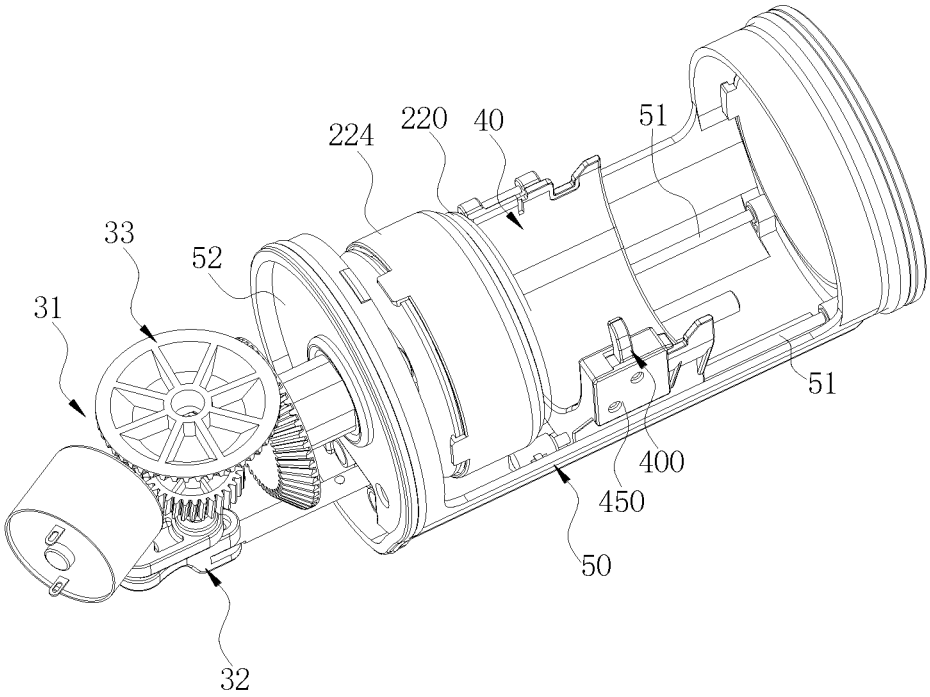
FIG. 5 is a first schematic view showing partial structure of the penis massager shown in FIG. 2.

Referring to FIG. 3 to FIG. 5, a mounting frame 40 is fixed on an outer side wall of the first sleeve 210, and the mounting frame 40 is slidably connected to the housing 10. A connecting frame 224 is fixed on an outer side of the second sleeve 220. One end of the first transmission mechanism 32 is in transmission connection with the mounting frame 40. In this way, the mounting frame 40 is driven by the first transmission mechanism 32 to linearly and axially move within the housing 10. One end of the second transmission mechanism 33 is connected to the connecting frame 224. In this way, the connecting frame 224 is driven by the second transmission mechanism 33 to rotate relative to the partitioning plate 52. Particularly, referring to FIG. 5 to FIG. 7, a support frame 50 is fixed within the housing 10, the partitioning plate 52 is disposed at one end of the support frame 50, two sliding rods 51 which are spaced from and parallel to each other are disposed within the support frame 50, and the sliding rods 51 slidably extend through the mounting frame 40. In this way, the mounting frame 40 is slidably connected to the support frame 50 through sliding rails, thereby achieving that the mounting frame 40 is slidably assembled in the housing 10. The actuator 31 can drive the mounting frame 40 through the first transmission mechanism 32 to slide back and forth relative to the support frame 50, and then driving the first sleeve 210 to slide back and forth.

Figure 6:
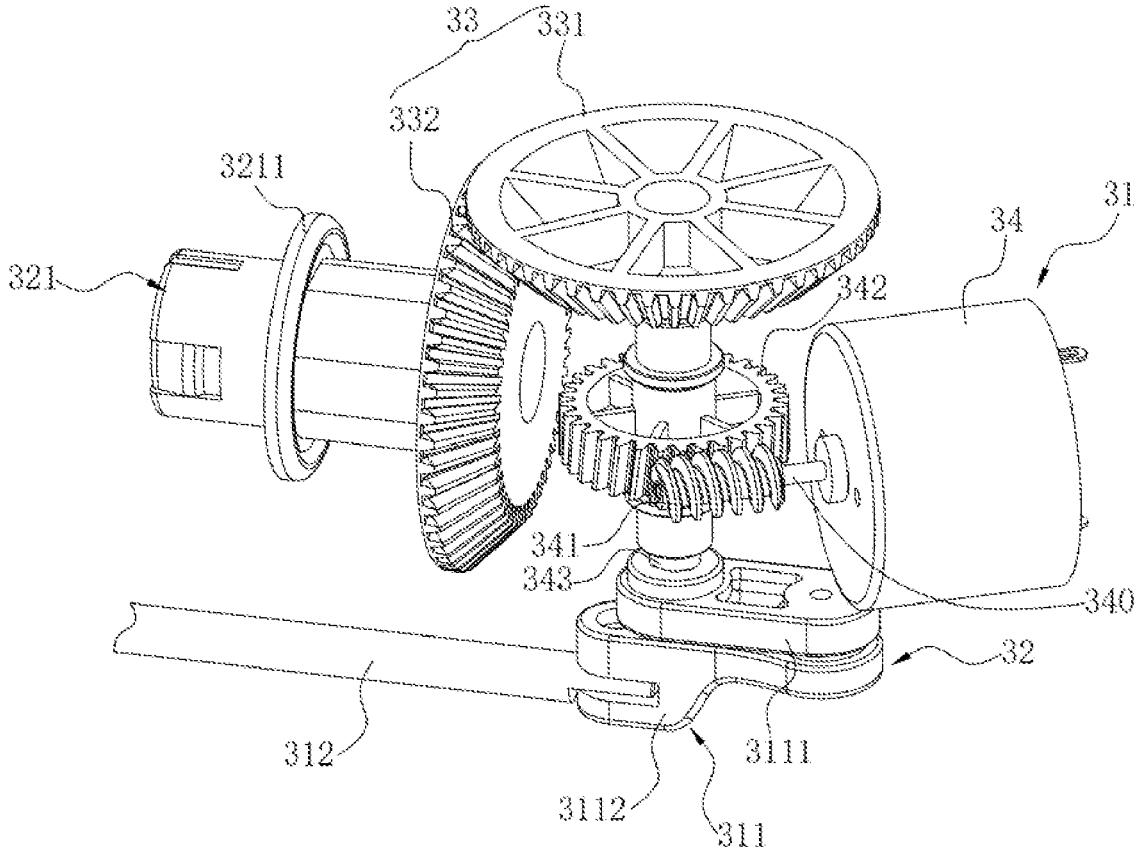
FIG. 6 is a second schematic view showing partial structure of the penis massager shown in FIG. 2.

Referring to FIG. 5 to FIG. 7, the first transmission mechanism 32 includes a lever assembly 311 and a connecting shaft 312. One end of the lever assembly 311 is rotationally connected to one end of the transmission shaft 343. The other end of the lever assembly 311 is hinged to one end of the connecting shaft 312. The other end of the connecting shaft 312 slidably extending through the partitioning plate 52 and is fixedly connected to the mounting frame 40. When the motor 34 drives the transmission shaft 343 to rotate, the transmission shaft 343 drives the mounting frame 40 to linearly move in the axial direction through the lever assembly 311 and the connecting shaft 312.

Preferably, the lever assembly 311 adopts a two-section type structure. The lever assembly 311 includes a first lever 3111 and a second lever 3112. One end of the first lever 3111 is connected to the transmission shaft 343. One end of the second lever 3112 is hinged to the other end of the first lever 3111. The other end of the second lever 3112 is hinged to one end of the connecting shaft 312. In this way, a rotary movement of the transmission shaft 343 is converted into a linear movement through the lever assembly 311, that is, the connecting shaft 312 is driven by the lever assembly 311 to linearly reciprocate. The connecting shaft 312 drives the mounting frame 40 to linearly reciprocate, and in turn drives the first sleeve 210 to linearly reciprocate within the housing 10.

Figure 8:
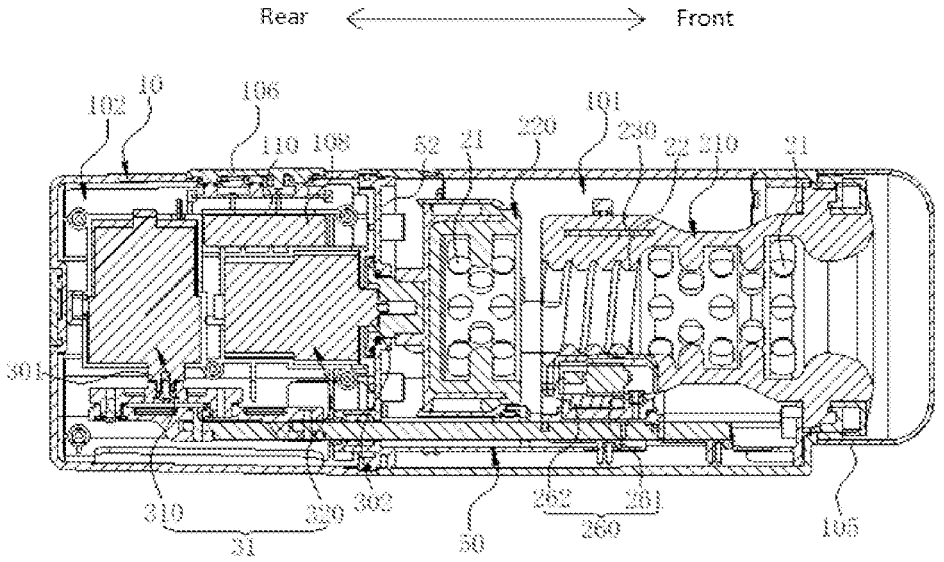
FIG. 8 is a sectional view of a penis massager according to another embodiment of the present disclosure.
Figure 9:
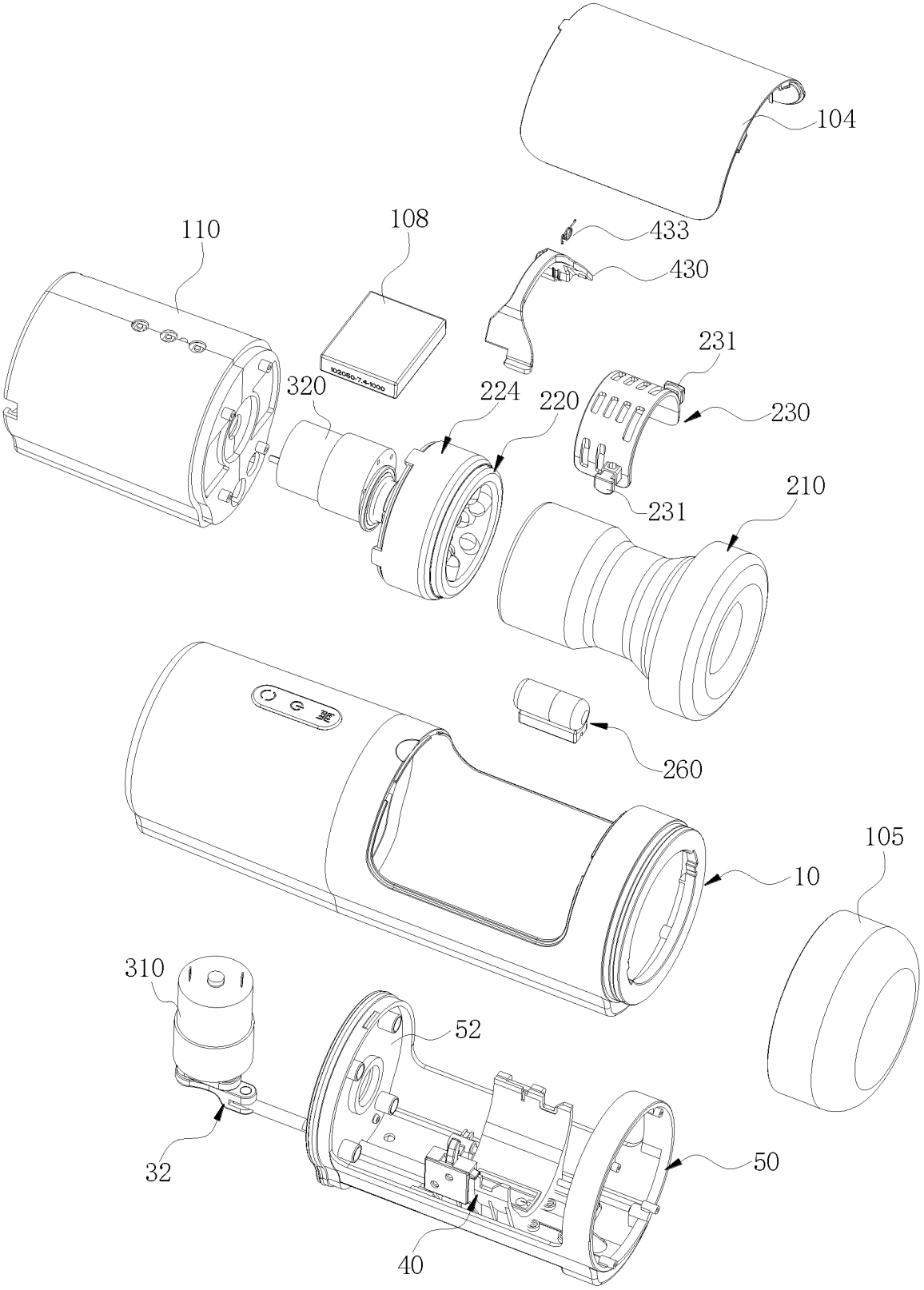
FIG. 9 is an exploded view of the penis massager shown in FIG. 8.
Figure 10:
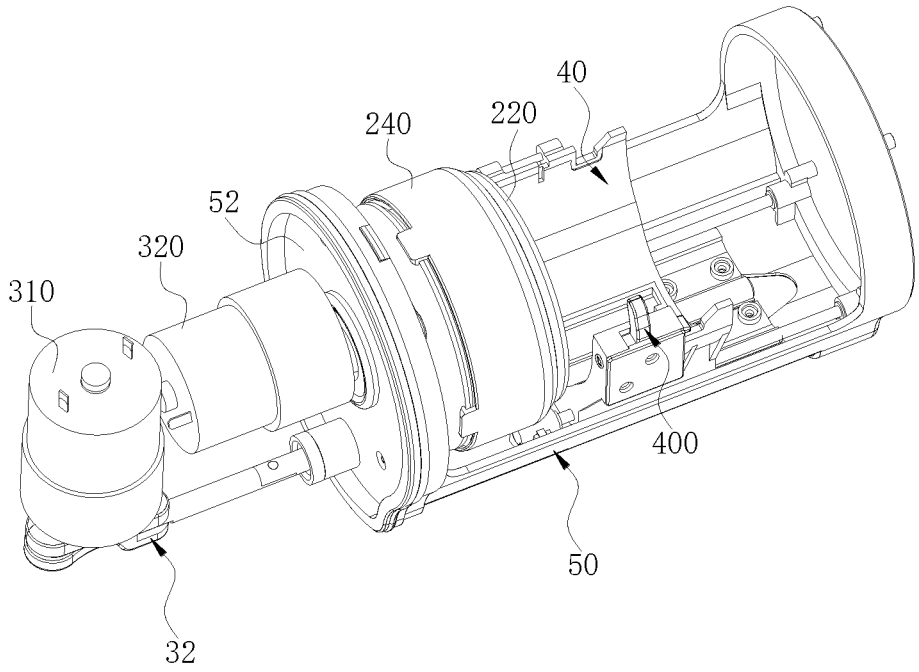
FIG. 10 is a first schematic view showing partial structure of the penis massager shown in FIG. 9.

Referring to FIG. 8 to FIG. 10, the driving apparatus 30 adopts the structure driven by the double motors. In this embodiment, the actuator 31 includes a first motor 310 and a second motor 320. The second motor 320 is disposed on a front side of the first motor 310. An output shaft of the first motor 310 serves as the first output shaft 301. An output shaft of the second motor 320 serves as the second output shaft 302. An axial direction of the output shaft of the second motor 320 is arranged to be parallel to an axial direction of the housing 10. The first transmission mechanism 32 includes a lever assembly 311 and a connecting shaft 312. The output shaft of the first motor 310 is vertically arranged, i.e., perpendicular to the axial direction of the housing 10. The output shaft of the first motor 310 is connected to one end of the lever assembly 311. The other end of the lever assembly 311 is hinged to one end of the connecting shaft 312. The other end of the connecting shaft 312 slidably extending through the partitioning plate 52 and is fixedly connected to the mounting frame 40. The first motor 310 drives the mounting frame 40 through the lever assembly 311 and the connecting shaft 312 to linearly move in the axial direction. Referring to FIG. 1 and FIG. 3 to FIG. 5, a fixed casing 110 is disposed within the second chamber 102, the first motor 310 and the second motor 320 are fixed within the fixed casing 110, and the output shafts of the first motor 310 and the second motor 320 extend out of the fixed casing 110. A rechargeable battery 108 is disposed within the housing 10, and the first motor 310 and the second motor 320 are electrically connected to the rechargeable battery 108, respectively.

Figure 11:
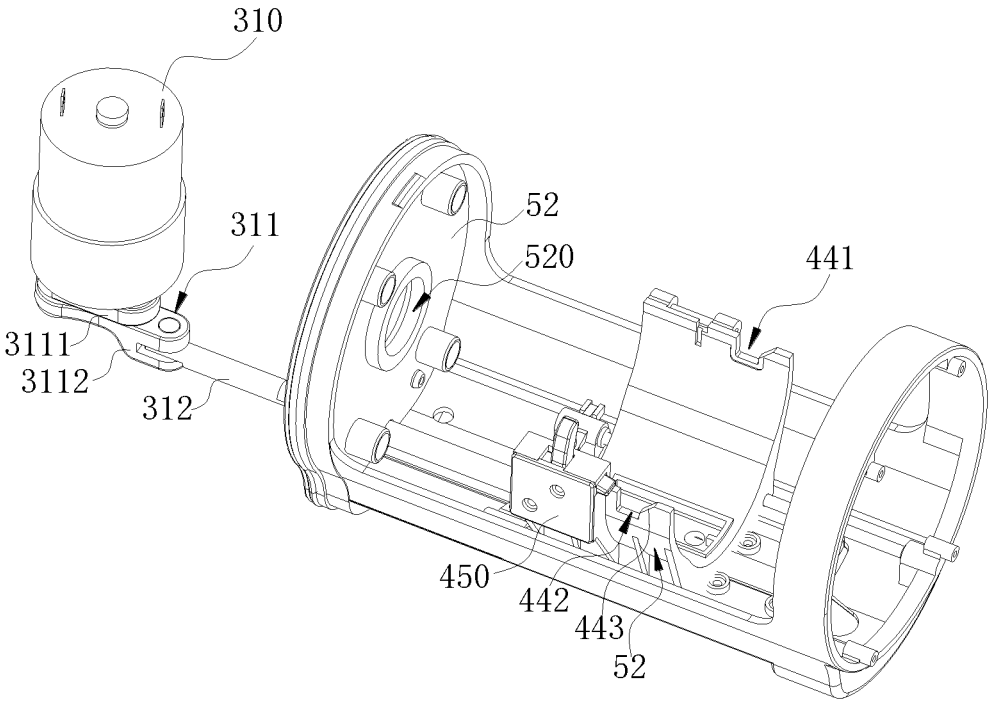
FIG. 11 is a second schematic view II showing partial structure of the penis massager shown in FIG. 9.

Referring to FIG. 9 to FIG. 11, the lever assembly 311 adopts a two-section type structure too. The lever assembly 311 includes a first lever 3111 and a second lever 3112. One end of the first lever 3111 is connected to the output shaft of the first motor 310 to be rotatable. One end of the second lever 3112 is hinged to the other end of the first lever 3111. The other end of the second lever 3112 is hinged to one end of the connecting shaft 312. In this way, a rotational movement of the output shaft of the first motor 310 is converted into a linear movement through the lever assembly 311, that is, the connecting shaft 312 is driven by the lever assembly 311 to linearly move, and then the mounting frame 40 is driven by the connecting shaft 312 to linearly move, and in turn, the first sleeve 210 is driven to linearly move within the housing 10.

The first sleeve 210 is provided with at least one of a vibration apparatus, a heating apparatus and an electric stimulating apparatus. Referring to FIG. 8 and FIG. 9, the vibrating apparatus 260 for generating a mechanical vibration is engaged in a side wall of the first sleeve 210. The vibrating apparatus 260 includes a motor 261 and a motor housing 262 mounted outside the motor 261. The vibrating apparatus 260 is located at a bottom of the side wall of the first sleeve 210. A control panel 106 is disposed on a top surface of a rear end of the housing 10 and provided with a function key to control the ON and OFF of the motor 261. After the motor 261 is energized, the first sleeve 210 can provide vibration massage to the penis. Keys controlling moving speeds of the first sleeve 210 and the second sleeve 220 are also provided on the control panel 106.

Figure 12:
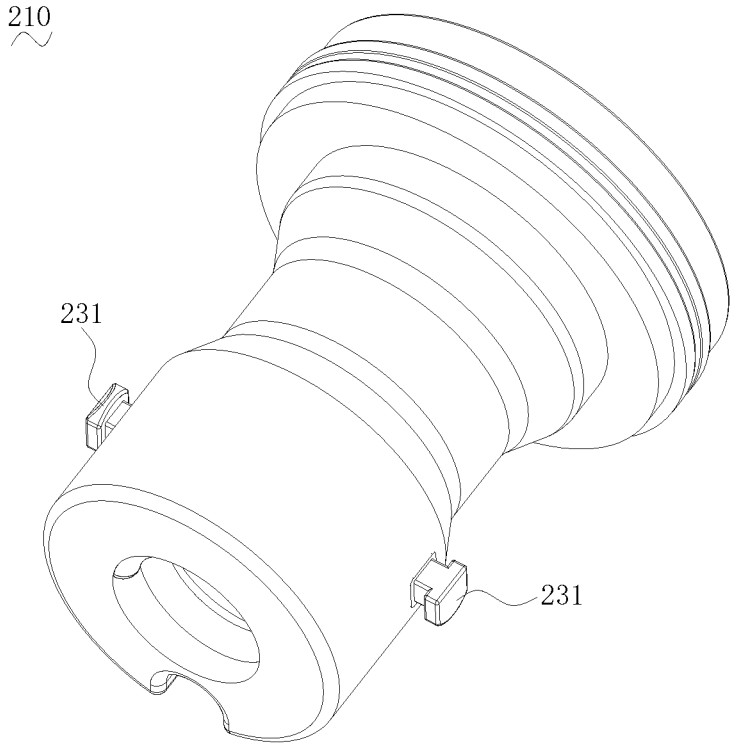
FIG. 12 is a perspective view of a first sleeve in the penis massager shown in FIG. 9.

Referring to FIG. 9, FIG. 10 and FIG. 12, a fixed frame 230 is disposed on an inner side wall of the first sleeve 210, and the fixed frame 230 is integrally formed with the first sleeve 210. two engaging blocks 231 are respectively disposed on a left side and a right side of the fixed frame 230. The engaging blocks 231 extend out of the side wall of the first sleeve 210. Preferably, the engaging blocks 231 are symmetrically disposed on the left side and the right side of the fixed frame 230. A self-locking assembly 400 is provided on the mounting frame 40 corresponding to the engaging blocks 231. The self-locking assembly 400 can be switched between a locked state and an unlocked state. When the self-locking assembly 400 is in the locked state, the engaging blocks 231 are locked on the mounting frame 40. When the self-locking assembly 400 is in the unlocked state, the first sleeve 210 can be removed from the mounting frame 40.

Figure 13:
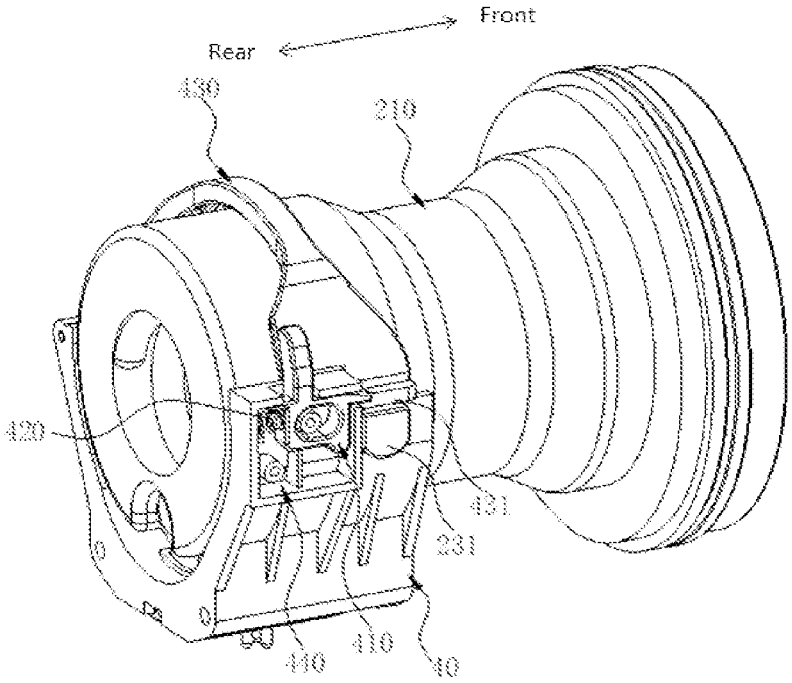
FIG. 13 is a schematic assembly view of the first sleeve in the penis massager shown in FIG. 9, wherein a self-locking assembly is in a locked state.
Figure 14:
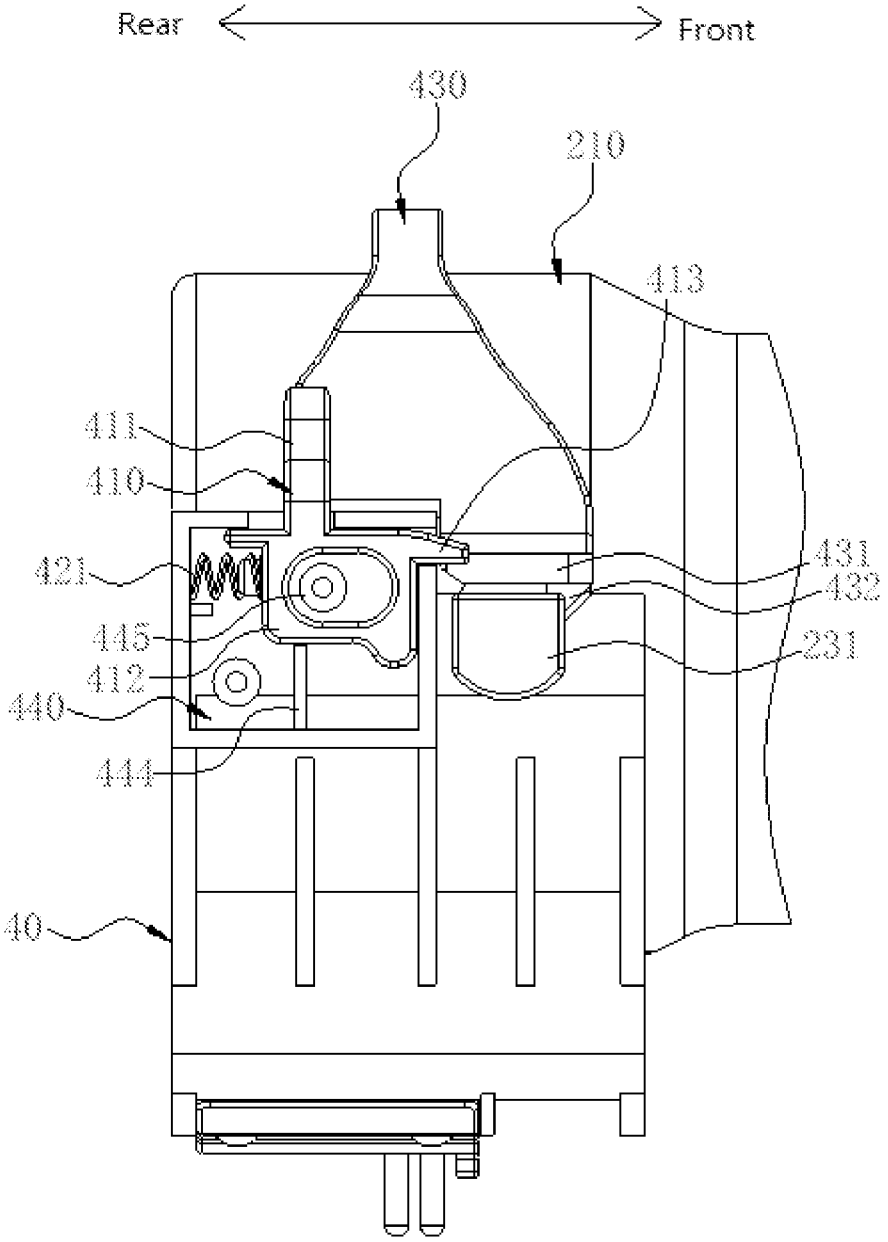
FIG. 14 is a schematic partial assembly view of the penis massager shown in FIG. 9, wherein the self-locking assembly is in the locked state.
Figure 15:
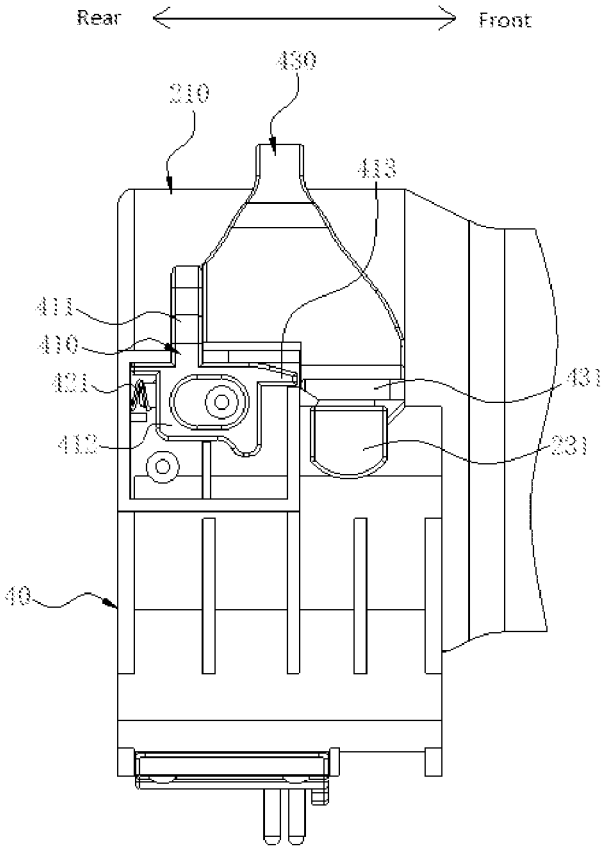
FIG. 15 is a schematic partial assembly view of the penis massager shown in FIG. 9, wherein the self-locking assembly is in an unlocked state.

Particularly, referring to FIG. 9, FIG. 10 and FIG. 13, the self-locking assembly 400 includes a pushing member 410, an elastic member 420 and a movable arm 430. The pushing member 410 is slidably connected to the mounting frame 40, and two ends of the elastic member 420 abut against the mounting frame 40 and the pushing member 410, respectively. One end of the movable arm 430 is hinged to the mounting frame 40. The pushing member 410 abuts against the other end of the movable arm 430 under an elastic force of the elastic member 420. In this way, the movable arm 430 can restrict the engaging blocks 231 on two sides onto the mounting frame 40, such that the first sleeve 210 is fixed relative to the mounting frame 40. An inner wall surface of the movable arm 430 may abut against the outer wall surface of the first sleeve 210, and a gap may exist between the inner wall surface of the movable arm 430 and the outer wall surface of the first sleeve 210.

Preferably, a cross section of the movable arm 430 traverse to the axial direction of the housing is C-shaped. A gap is formed between the inner wall surface of the movable arm 430 and the outer wall surface of the first sleeve 210. The C-shaped movable arm 430 may minimize the gap between the movable arm 430 and the first sleeve 210 and the overall structure is more compact.

Preferably, a cross section of the mounting frame 40 traverse to the axial direction of the housing is U-shaped. An inner wall surface of the mounting frame 40 is in contact with the outer wall surface of the first sleeve 210. An outer wall surface of the mounting frame 40 is matched with an inner wall surface of the support frame 50. Two ends of the mounting frame 40 partially extend out of the support frame 50.

Particularly, referring to FIG. 11 and FIG. 13 to FIG. 15, a mounting groove 440 is provided in an outer side wall of one side of the mounting frame 40. The elastic member 420 is accommodated in the mounting groove 440. The pushing member 410 is partially accommodated in the mounting groove 440. The pushing member 410 is slidably connected to the mounting groove 440. A first notch 441 and a second notch 442 are provided in a left side and a right side of the mounting frame 40, respectively. In this embodiment, the first notch 441 is positioned on the right side of the mounting frame 40, the second notch 442 is positioned on the left side of the mounting frame 40, the second notch 442 is close to the outer wall surface of the mounting groove 440 and is positioned on the front side of the mounting groove 440. The right end of the movable arm 430 is hinged to the mounting frame 40 through an axle. When the self-locking assembly 400 is in the locked state, the engaging block 231 at the right side is restricted in the first notch 441 by the right end of the movable arm 430. Due to the elastic force of the elastic member 420, one end of the pushing member 410 extends out of the mounting groove 440 and abuts against the left end of the movable arm 430, such that the engaging block 231 at the left side is limited at the second notch 442 by the left end of the movable arm 430.

Particularly, the pushing member 410 includes an operating portion 411, a sliding portion 412 and an engaging portion 413 connected each other. A through hole is provided in a bottom of the mounting groove 440. One end of the operating portion 411 extends out of the through hole to serve as an operating end to be manually pushed. A limiting plate 444 is vertically disposed within the mounting groove 440. A bottom surface of the sliding portion 412 abuts against and supported by the limiting plate 444. The sliding portion 412 is slidably connected to the mounting groove 440 through the limiting plate 444. The sliding portion 412 is provided with a positioning groove at a central portion extending along the sliding direction of the sliding portion 412, and two ends of the positioning groove along its extension are spaced from the left and right edges of the sliding portion 412. The mounting groove 440 is provided with a limiting column 445 corresponding to the positioning groove, so as to limit the maximum travel of the sliding portion 412 sliding back and forth within the mounting groove 440. An opening corresponding to the engaging portion 413 is provided in a wall of a front side of the mounting groove 440. One end of the elastic member 420 abuts against one side of the sliding portion 412, and the other end of the elastic member 420 abuts against the wall of the mounting groove 440. An extending section 431 extending horizontally is provided at the other end of the movable arm 430. When the self-locking assembly 400 is in the locked state, due to the elastic force of the elastic member 420, one end of the engaging portion 413 extends out of the opening in the front side of the mounting groove 440 and abuts against a top surface of the extending section 431 of the movable arm 430, such that the engaging block 231 is locked at the second notch 442 of the mounting frame 40 by the extending section 431. When a force is applied to push the operating portion 411 of the pushing member 410 towards the rear end, the elastic member 420 is compressed by the sliding portion 412, the sliding portion 412 and the engaging portion 413 move backwards, and the engaging portion 413 releases the extending section 431 of the movable arm 430. At this time, the self-locking assembly 400 is in the unlocked state, and the movable arm 430 is rotatable and can be opened after rotation. After the movable arm 430 is opened by rotating around the mounting frame 40, the first sleeve 210 can be taken out of the mounting frame 40.

Particularly, the elastic member 420 is a compression spring 421. It should be understood that the elastic member 420 may be other elastic components, such as a leaf spring or an elastic injection molded part. The mounting frame 40 is provided with a side cover 450 at the position of the mounting groove 440. The side cover 450 is fixedly connected to the mounting frame 40 by a screw. The side cover 450 covers the mounting groove 440.

Figure 16:
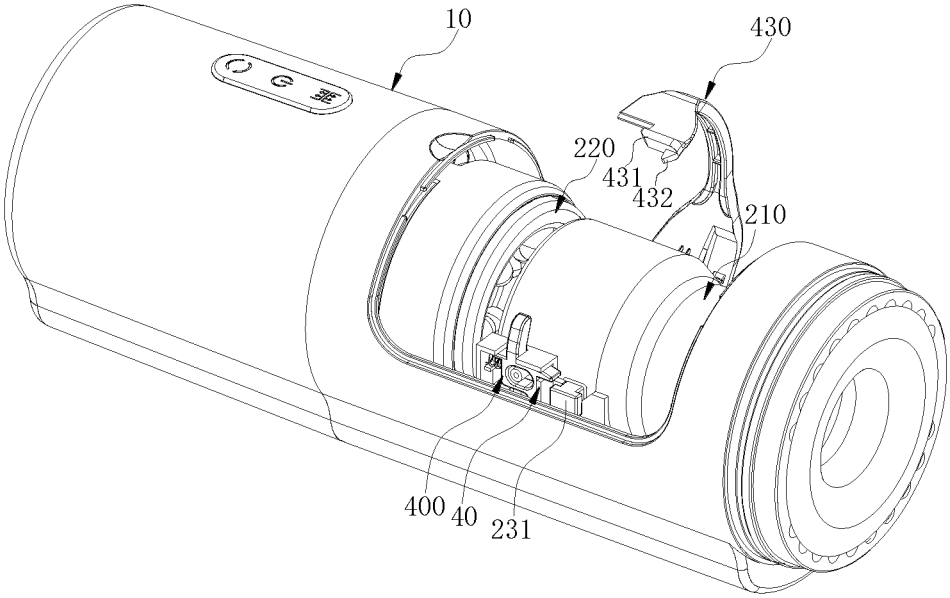
FIG. 16 is a schematic view of a use state of the penis massager shown in FIG. 9, wherein the self-locking assembly is in the unlocked state.

Referring to FIG. 9, FIG. 11 and FIG. 16, a torsion spring 433 is arranged between one end of the movable arm 430 and the mounting frame 40, that is, the torsion spring 433 is arranged to bias the end of the movable arm 430 hinged to the mounting frame 40. When the self-locking assembly 400 is in the unlocked state, the movable arm 430 can automatically rotate and pop up under the elastic force of the torsion spring 433. Preferably, after the force is applied to push the pushing member 410, the movable arm 430 can automatically pop by a preset angle relative to the mounting frame 40, such that there is no need of an operation of manually opening the movable arm 430.

Preferably, inclined guiding surfaces 443 are provided on sides of the first notch 441 and the second notch 442 of the mounting frame 40, to facilitate the engaging blocks 231 on the left side and the right side of the first sleeve to be engaged into the notches. When the engaging block 231 is engaged in the second notches 442, a clearance is formed between each engaging block 231 and the guiding surface 443 of the second notch 442. A protruding block 432 is provided on a bottom surface of the extending section 431 of the movable arm 430. A shape of the protruding block 432 is matched with a shape of the clearance. While the extending section 431 of the movable arm 430 abuts against the corresponding engaging block 231, the protruding block 432 is inserted in the clearance defined between the engaging block 231 and the guiding surface 443 at the second notch 442. One side of the protruding block 432 abuts against one side of the engaging block 231, and the other side of the protruding block 432 abuts against the guiding surface 443. In this way, when the self-locking assembly 400 is in the locked state, the first sleeve 210 can be prevented from shaking back and forth relative to the mounting frame 40.

Figure 17:
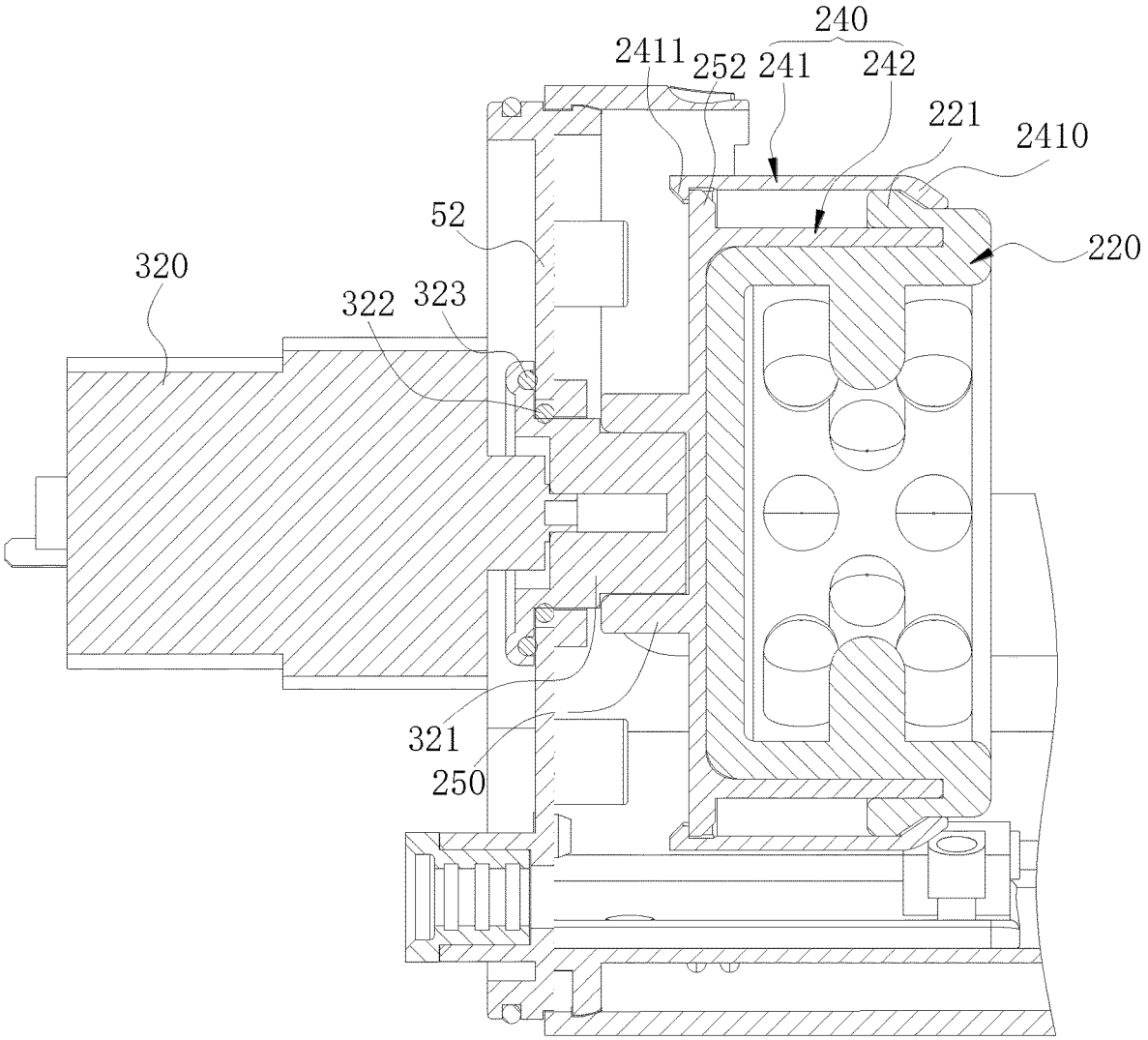
FIG. 17 is a partial sectional view of the penis massager shown in FIG. 9.

Referring to FIG. 8, FIG. 9 and FIG. 17, preferably, the connecting frame 224 is a sleeve 240 fixedly mounted outside the second sleeve 220, and the sleeve 240 is fixed relative to the second sleeve 220. The partitioning plate 52 is provided with a mounting hole 520, and a connecting joint 321 is rotatably arranged at the mounting hole 520 of the partitioning plate 52. An extending portion extending in an axial direction of the housing 10 is disposed at the mounting hole 520 of the partitioning plate 52. The extending portion is positioned in the first chamber 101, and positioned at the periphery of the connecting joint 321, that is, the extending portion is mounted outside the connecting joint 321, such that the extending portion provides a support for the connecting joint 321 and makes the rotational connection between the connecting joint 321 and the partitioning plate 52 more stable. One axial end of the third worm gear 332 is connected to one end of the connecting joint 321, and one end of the sleeve 240 is connected to the other end of the connecting joint 321. The third worm gear 332 drives the sleeve 240 to rotate through the connecting joint 321, and then drives the second sleeve 220 to rotate relative to the partitioning plate 52.

Figure 18:
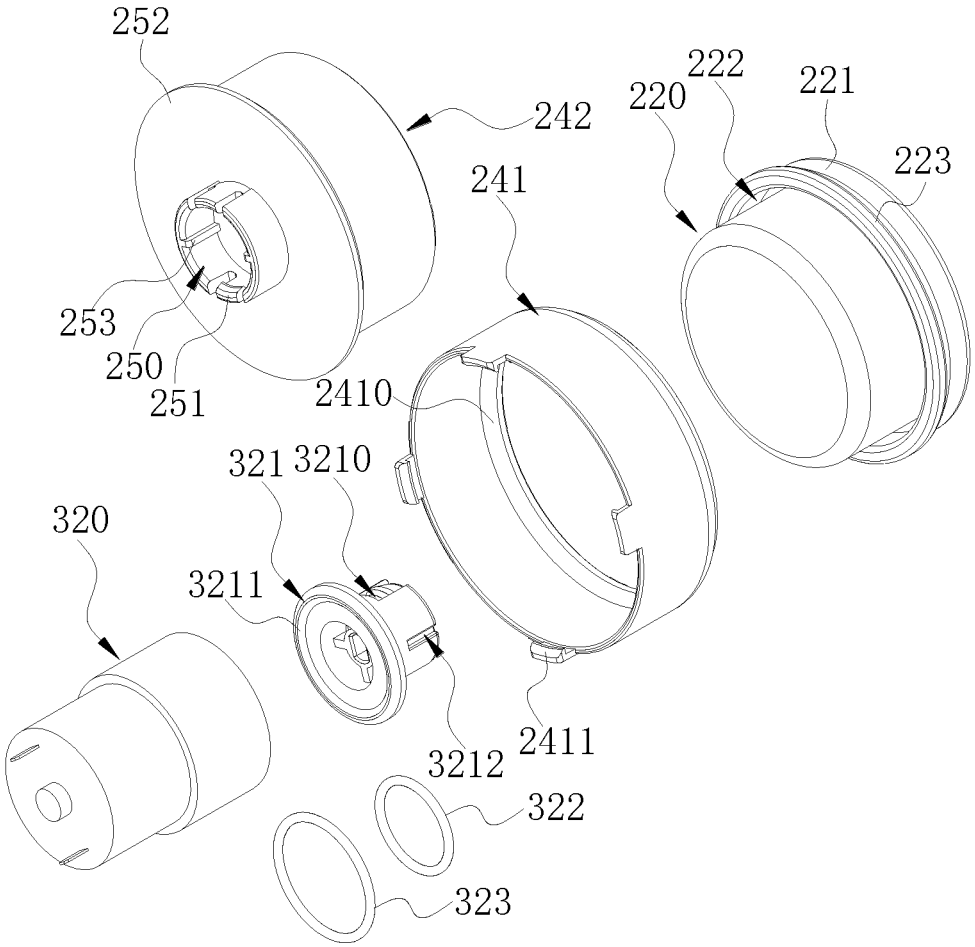
FIG. 18 is a schematic partially-exploded view of the penis massager shown in FIG. 9.

Referring to FIG. 9, FIG. 17 and FIG. 18, a connecting portion 250 extending axially is disposed at a rear end of the sleeve 240, and integrated with the sleeve 240. The other end of the connecting joint 321 is engaged with the connecting portion 250. Snap-fit structures matched each other are provided between the connecting joint 321 and the connecting portion 250, and the connecting joint 321 is engaged with the connecting portion 250 by means of the snap-fit structures.

Particularly, the connecting portion 250 is tubular, and the connecting portion 250 is integrally formed with the sleeve 240. The connecting portion 250 and the sleeve 240 are coaxially arranged, and their central axes coincide. A plurality of first hooks 251 are provided on an inner side wall of the connecting portion 250, and a plurality of engaging grooves 3210 are provided in an outer peripheral wall of the connecting joint 321. The plurality of first hooks 251 are corresponding to the plurality of engaging grooves 3210 respectively. The first hooks 251 are engaged in the engaging grooves 3210. The other end of the connecting joint 321 is inserted into the connecting portion 250. The connecting joint 231 is snap-fitted with the engaging grooves 3210 by means of the first hooks, as such, the snap-fit connection of the connecting joint 321 is achieved by snap fitting of the first hooks 251 and the engaging grooves 3210. Particularly, two first hooks 251 are symmetrically provided on the inner side wall of the connecting portion 250, and the inner side wall of the connecting portion 250 is provided with two slits on two sides of the first hooks 251, respectively such that the first hooks 251 have an elasticity, which is convenient for the first hooks 251 to be engaged into the engaging grooves 3210 of the connecting joint 321.

Preferably, a plurality of positioning ribs 253 are provided on the inner side wall of the connecting portion 250 at intervals, a plurality of positioning grooves 3212 are provided in an outer peripheral wall of the connecting joint 321, and the plurality of positioning grooves 3212 are corresponding to the plurality of positioning ribs 253 respectively. In this way, when the connecting joint 321 is mounted on the connecting portion 250, the engaging grooves 3210 on the connecting joint 321 can be exactly aligned with the corresponding first hooks 251 when the connecting joint 321 is inserted into the connecting portion 250 by aligning the positioning grooves 3212 with the positioning ribs 253, thereby achieving that the connecting joint 321 and the connecting joint 250 are accurately mounted. By means of the positioning ribs 253 and the positioning grooves 3212, the assembling operation between the connecting joint 321 and the connecting portion 250 can be facilitated.

Particularly, a collar 221 is provided on a front end of the second sleeve 220, the collar 221 is integrated with the second sleeve 220, and the collar 221 is formed by turning invertedly a wall surface of the front end of the second sleeve 220. An annular groove 222 is formed between the collar 221 and the outer peripheral wall of the second sleeve 220. A retaining flange 223 extending radially is formed on an outer wall surface of the collar 221. The sleeve 240 includes an outer tube 241 and an inner tube 242 which are snap-fitted together. A front end and a rear end of the outer tube 241 are provided with openings, respectively. The inner tube 242 is of a structure in which a front end is provided with an opening and a rear end is closed. The connecting portion 250 is integrally formed on an end face of the rear end of the inner tube 242. The wall thickness of the inner tube 242 is suitable for inserting into the annular groove 222. The front end of the inner tube 242 is engaged in the annular groove 222, in particular, the inner tube 242 is in interference fit with the annular groove 222. A retaining edge 2410 extending inwards radially is provided at the front end of the outer tube 241. The outer tube 241 is mounted outside the second sleeve 220. The retaining edge 2410 of the outer tube 241 abuts against the retaining flange 223 of the collar 221. A plurality of second hooks 2411 are disposed on an end surface of the rear end of the outer tube 241 at intervals, an annular flange 252 extending radially is formed on the rear end of the inner tube 242, and the second hooks 2411 are snap-fitted with the flange 252. In other words, the outer tube 241 and the inner tube 242 are snap-fitted together through the second hooks 2411 and the flange 252. The front end of the inner tube 242 is engaged in the annular groove 222 of the second sleeve 220. In this way, the second sleeve 220 is fixedly engaged between the outer tube 241 and the inner tube 242, such that the second sleeve 220 is fixed within the sleeve 240. Particularly, four second hooks 2411 are evenly disposed on the end face of the rear end of the outer tube 241 at intervals in a circumferential direction. The outer tube 241 and the inner tube 242 are snap-fitted together by means of the four second hooks 2411.

A connecting flange 3211 extending radially is provided at a rear end of the connecting joint 321. The connecting flange 3211 is positioned within the second chamber 102. Sealing rings are disposed between the connecting flange 3211 and the partitioning plate 52, and the sealing rings are clamped between the connecting flange 3211 and the partitioning plate 52. The sealing rings are provided to improve the sealing performance between the connecting flange 3211 and the partitioning plate 52, and reduce the noise generated when the connecting joint 321 rotates. Particularly, there are two sealing rings, namely, the first sealing ring 322 and the second sealing ring 323. The partitioning plate 52 is provided with a first annular groove on one side adjacent to the second chamber 102 around the mounting hole 520, the first sealing ring 322 is accommodated in the first annular groove, and one end of the first sealing ring 322 abuts against the connecting flange 3211. One side of the connecting flange 3211 facing the partitioning plate 52 is provided with a second annular groove, the second sealing ring 323 is accommodated in the second annular groove, and one end of the second sealing ring 323 abuts against the side surface of the partitioning plate 52 is clamped between the partitioning plate 52 and the connecting flange 3211. A diameter of the second sealing ring 323 is greater than that of the first sealing ring 322.

Referring to FIG. 3, FIG. 5 and FIG. 6, in the structure driven by the single motor, the connecting joint 321 has a larger axial length. The connecting flange 3211 extending radially is provided on the outer wall surface of the connecting joint 321. The connecting flange 3211 is positioned in the second chamber 102. One side of the connecting flange 3211 is in contact with the partitioning plate 52, and the connecting flange 3211 makes the connecting joint 321 unmovable in the axial direction when rotating relative to the partitioning plate 52, thereby driving the sleeve 240 to rotate.

The above are only preferable embodiments of the present disclosure and are not intended to limit the present disclosure. Any modification, equivalent replacement and improvement made within the spirit and principle of the present disclosure shall fall in a scope of protection of the present disclosure.

The invention claimed is:

1. A penis massager, comprising:

a housing;

a massaging member comprising a first sleeve and a second sleeve which are spaced apart, the first sleeve being positioned at a front side of the second sleeve, the first sleeve has an inner lumen penetrating two axial ends thereof to allow a head of the penis to extend through the first sleeve and enter into the second sleeve, and the second sleeve being rotatably disposed; and an actuator disposed within the housing and in transmission connection with the massaging member, the actuator being capable of driving the first sleeve to linearly move in an axial direction along the penis inserted in the first sleeve, and driving the second sleeve to rotate relative to the housing.

2. The penis massager of claim 1, wherein the actuator comprising a first output shaft and a second output shaft; the first output shaft being in transmission connection with the first sleeve through a first transmission mechanism, and the second output shaft being in transmission connection with the second sleeve.

3. The penis massager of claim 2, wherein a partitioning plate is mounted within the housing and divides an internal cavity of the housing into a first chamber and a second chamber, the massaging member is disposed in the first chamber, the second sleeve is rotatably arranged on the partitioning plate, and the actuator is arranged in the second chamber.

4. The penis massager of claim 3, wherein a mounting frame is fixed on an outer side wall of the first sleeve, the mounting frame is slidably connected to the housing, the first output shaft is in transmission connection with the mounting frame through the first transmission mechanism to drive the mounting frame to linearly move in the axial direction within the first chamber; and wherein a connecting frame is fixed on an outer side of the second sleeve, the connecting frame is rotatably disposed on the partitioning plate, and the second output shaft is in transmission connection with the connecting frame to drive the connecting frame to rotate relative to the partitioning plate.

5. The penis massager of claim 4, wherein the first transmission mechanism comprises a lever assembly and a connecting shaft, the first output shaft is connected to one end of the lever assembly, an other end of the lever assembly is hinged to one end of the connecting shaft, and an other end of the connecting shaft slidably passes through the partitioning plate to be fixedly connected to the mounting frame.

6. The penis massager of claim 5, wherein the lever assembly comprises a first lever and a second lever, one end of the first lever is connected to the first output shaft, one end of the second lever is hinged to an other end of the first lever, and an other end of the second lever is hinged to the one end of the connecting shaft.

7. The penis massager of claim 4, wherein a fixed frame is disposed on an inner side wall of the first sleeve, engaging blocks are respectively provided on a left side and a right side of the fixed frame, the engaging blocks extend out of a side wall of the first sleeve; a self-locking assembly snap-fitted with the engaging blocks are disposed on the mounting frame, the self-locking assembly is switchable between a locked state and an unlocked state, the self-locking assembly locks the engaging blocks on the mounting frame in the locked state, and the first sleeve is removable from the mounting frame when the self-locking assembly is in the unlocked state.

8. The penis massager of claim 7, wherein the self-locking assembly comprises a pushing member, an elastic member and a movable arm, the pushing member is slidably connected to the mounting frame, two ends of the elastic member respectively abut against the mounting frame and the pushing member, and one end of the movable arm is hinged to the mounting frame; when the self-locking assembly is in the locked state, the pushing member abuts against an other end of the movable arm under an elastic force of the elastic member, such that the movable arm presses the engaging blocks on two sides against the mounting frame; and after the pushing member is moved in an unlocking direction, the self-locking assembly is switched into the unlocked state, the pushing member is separated from the movable arm, and the other end of the movable arm is released and capable of being opened by rotating around the mounting frame.

9. The penis massager of claim 8, wherein a mounting groove is provided in an outer side wall of one side of the mounting frame, the elastic member is accommodated in the mounting groove, the pushing member is slidably received in the mounting groove, and the pushing member is partially accommodated in the mounting groove; a first notch and a second notch are respectively provided in a left side and a right side of the mounting frame, and the second notch is adjacent to the mounting groove; and wherein when the self-locking assembly is in the locked state, one of the engaging blocks is restricted at the first notch by the one end of the movable arm, and one end of the pushing member extends out of the mounting groove to abut against the other end of the movable arm, such that an other one of the engaging block is locked at the second notch by the other end of the movable arm.

10. The penis massager of claim 9, wherein the pushing member comprises an operating portion, a sliding portion and an engaging portion; one end of the operating portion extends out of the mounting groove to form an operating end to be pushed manually, the sliding portion is slidably connected to the mounting groove, one end of the elastic member abuts against one side of the sliding portion, and an other end of the elastic member abuts against a wall of the mounting groove; and wherein when the self-locking assembly is in the locked state, one end of the engaging portion extends out of the mounting groove and abuts against a top surface of the other end of the movable arm.

11. The penis massager of claim 9, wherein a torsion spring is disposed between the one end of the movable arm and the mounting frame, and wherein when the self-locking assembly is in the unlocked state, the movable arm is capable of automatically rotating and popping up under an elastic force of the torsion spring.

12. The penis massager of claim 4, wherein the connecting frame is a sleeve fixed around the second sleeve, the partitioning plate is provided with a mounting hole, a connecting joint is rotatably disposed at the mounting hole, the second output shaft is in transmission connection with one end of the connecting joint, and one end of the sleeve is connected to an other end of the connecting joint.

13. The penis massager of claim 12, wherein a connecting portion extending axially is disposed at a rear end of the sleeve, and the other end of the connecting joint is snap-fitted with the connecting portion.

14. The penis massager of claim 13, wherein the connecting portion is tubular, a plurality of first hooks are provided on an inner side wall of the connecting portion, a plurality of engaging grooves are provided in an outer peripheral wall of the connecting joint, the plurality of first hooks are corresponding to the plurality of the engaging grooves respectively, the other end of the connecting joint is inserted into the connecting portion, and snap-fit connection with the connecting portion is achieved by snap fitting the first hooks and the engaging grooves.

15. The penis massager of claim 13, wherein a connecting flange extending radially is provided at a rear end of the connecting joint, the connecting flange is positioned in the second chamber, a sealing ring is disposed between the connecting flange and the partitioning plate, and the sealing ring is clamped between the connecting flange and the partitioning plate.

16. The penis massager of claim 13, wherein a collar is disposed at a front end of the second sleeve, an annular groove is formed between the collar and an outer peripheral wall of the second sleeve, a retaining flange extending radially is formed on an outer wall surface of the collar, the sleeve comprises an outer tube and an inner tube, a front end and a rear end of the outer tube are opened, a front end of the inner tube is opened and a rear end of the inner tube is closed, the connecting portion is provided on an end surface of the rear end of the inner tube, the front end of the inner tube is engaged in the annular groove, a retaining edge extending radially is provided at a front end of the outer tube, the outer tube is mounted outside the second sleeve, and the retaining edge abuts against the retaining flange, a plurality of second hooks are provided on an end surface of the rear end of the outer tube at intervals, a flange extending radially is formed at a rear end of the inner tube, and the second hooks are snap-fitted with the flange.

17. The penis massager of claim 1, wherein the actuator comprises a single motor having an output shaft, a worm shaft, a worm gear and a transmission shaft, one end of the worm shaft is connected to the output shaft of the motor, the worm gear is fixedly mounted around the transmission shaft, the worm shaft meshes with the worm gear, and two ends of the transmission shaft serve as the first output shaft and the second output shaft, respectively.

18. The penis massager of claim 17, wherein the second output shaft is in transmission connection with the second sleeve through a second transmission mechanism, the second transmission mechanism comprises a second worm gear and a third worm gear which mesh each other, the second worm gear is connected onto the second output shaft; and a fixed casing is disposed within the housing, the actuator is accommodated within the fixed casing, one axial end of the third worm gear is rotationally connected to a front side of the fixed casing, and an other axial end of the third worm gear is connected to the second sleeve.

19. The penis massager of claim 1, wherein the actuator comprises a first motor and a second motor arranged at a front side of the first motor, an output shaft of the first motor serves as the first output shaft, and an output shaft of the second motor serves as the second output shaft.

20. The penis massager of claim 1, wherein the first sleeve is provided with at least one of a vibrator, a heater and an electrical stimulating apparatus.

* * * * *